US005192259A

United States Patent [19]

Budolfson

[11] Patent Number: 5,192,259

[45] Date of Patent: Mar. 9, 1993

[54] EXERCISE SYSTEM

[76] Inventor: Robert A. Budolfson, 18525 Sixth Ave. North, Plymouth, Minn. 55447

[21] Appl. No.: 731,995

[22] Filed: Jul. 18, 1991

[51] Int. Cl.[5] ..... A63B 21/06

[52] U.S. Cl. ..... 482/93; 273/67 A

[58] Field of Search ..... 273/58 A, 67 R, 67 A, 273/87.2, 58 R, 129 L; 148/12 R; 482/93, 148

[56] References Cited

U.S. PATENT DOCUMENTS

| | | | |
|---|---|---|---|
| 1,779,187 | 10/1930 | Pearson | 273/58 R |
| 2,304,322 | 12/1942 | Werlich | 273/67 A |
| 3,149,840 | 9/1964 | Swanson | 273/129 L |
| 3,181,864 | 5/1965 | Rolke | 273/58 A X |
| 3,720,410 | 3/1973 | Sattar | 273/67 A |
| 3,844,555 | 10/1974 | Tremblay | 273/67 A |
| 3,844,844 | 10/1974 | Sato | 148/12 RX |
| 4,492,380 | 1/1985 | Sattar | 273/57.2 X |
| 4,512,573 | 4/1985 | Cooler | 273/67 A |

OTHER PUBLICATIONS

The Cosom Hockey Stick Advertised to the Sporting Goods Dealer, Aug. 1970, p. 205.

The Shields Hockey Stick Advertised to the Sporting Goods Dealer, Jun. 1981, p. 109.

*Primary Examiner*—Robert Bahr

[57] ABSTRACT

An exercise system for developing wrists and hands comprising a wooden hockey stick having an elongated handle portion and a blade portion, and a spherically shaped heavy metal ball.

1 Claim, 2 Drawing Sheets

EXERCISE SYSTEM

SUMMARY OF THE INVENTION

This invention provides a simple, yet extremely effective system for developing and strengthening the hands and wrists of an athlete. While the invention is especially advantageously useable by ice hockey athletes (notice being taken that hockey players performance is, to a remarkable extent, dependent upon the strength of the hands and wrists of the athlete), the invention may be advantageously used by other athletes and non-athletes who desire to have strong hands and wrists.

The invention is an exercise system adapted to be used on a flat, hard surface such as a concrete, hard asphalt, or wooden planar surface, e.g., a garage floor surface. The system comprises a wooden hockey stick having an elongated handle portion and a double-sided blade portion. The remaining element of the system is a spherically shaped solid ball made from a dense material. The ball is placed on the surface. The athlete holds the elongated handle portion of the stick with spaced apart hands, causes one side of the blade portion of the stick to engage the ball to thereby first accelerate the ball from an initial location and then rapidly moves the stick to have the other side of the blade portion engage the accelerated ball to thereby decelerate the ball to bring the ball to rest and then, as part of the same motion accelerate the ball back toward the initial starting point.

DESCRIPTION OF THE PREFERRED EMBODIMENT

Figure 1:
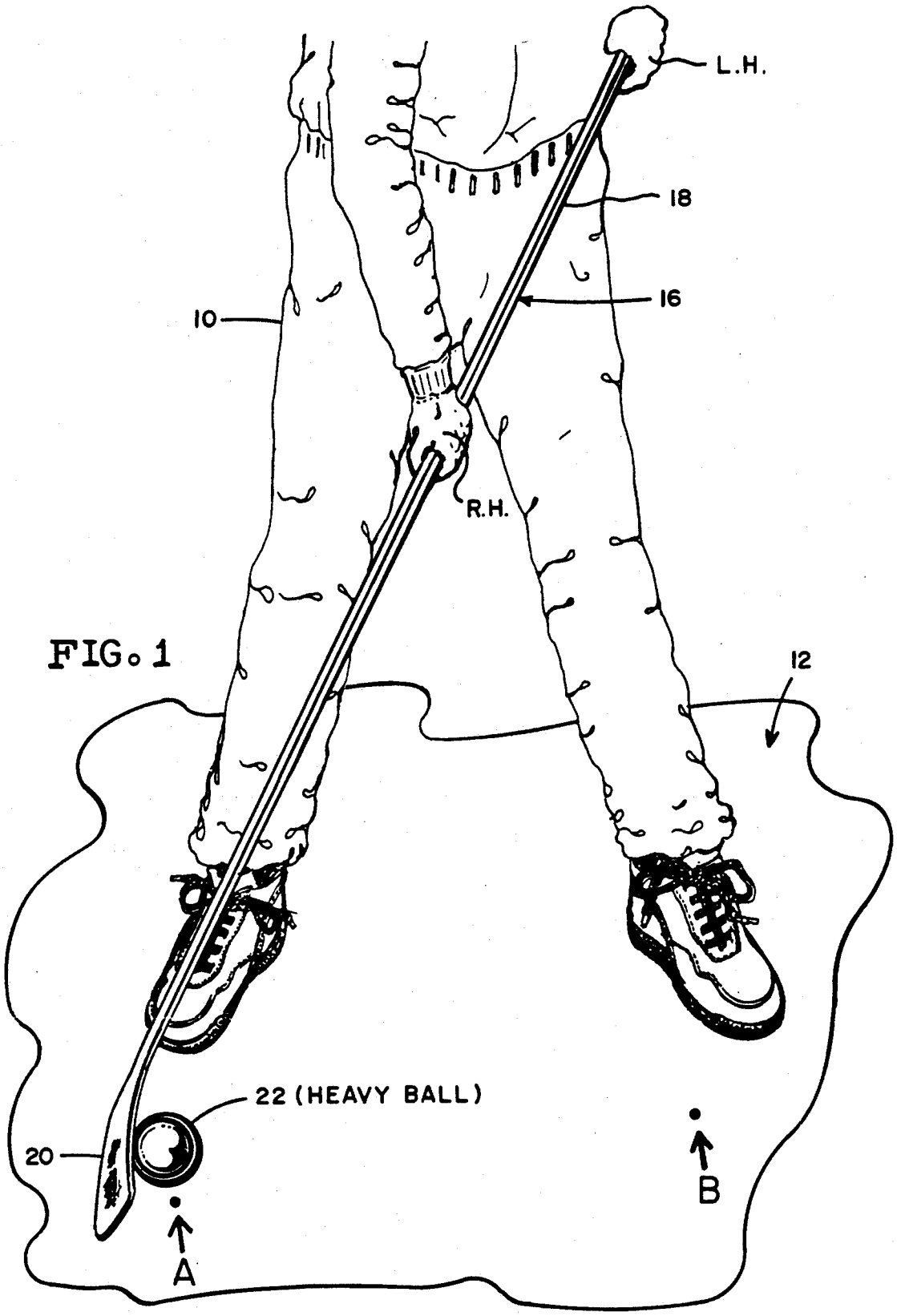
FIG. 1 is a pictorial view of an athlete operating the system covered by this invention.

The preferred embodiment of my invention is disclosed in the drawings; in FIG. 1 an exercise system is depicted for developing and strengthening the wrists and hands of a human athlete 10 the system being adapted to be used on a flat hard planar surface 12. As indicated the flat hard surface could be the concrete surface such as a garage floor or driveway. Other hard surfaces which are suitable include hard asphalt or wooden planar surfaces.

The system comprises a wooden hockey stick of the type commercially available and used for ice hockey the stick being identified by reference numeral 16 having an elongated handle portion 18 and a double sided blade portion 20.

Figure 2:
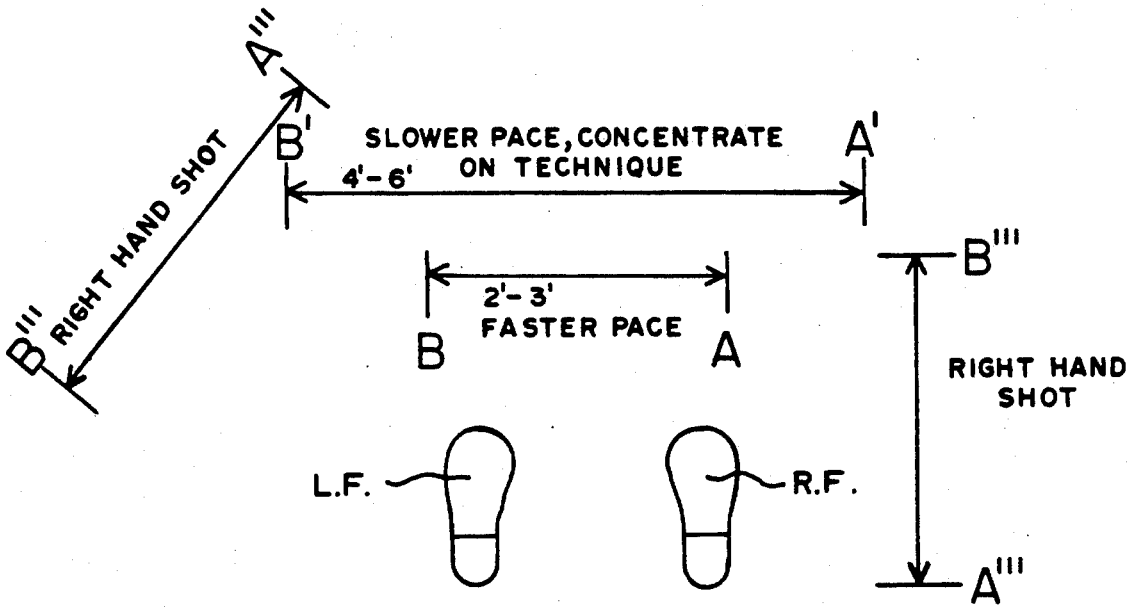
FIG. 2 is a diagram of possible exercises using the system.

The remaining element of the system is a spherically shaped ball 22 made from a dense material such as forged steel. The ball 22 is placed by the athlete on the surface 12. The athlete holds the elongated handle portion 18 of the stick with spaced apart hands. In FIG. 1 the left hand LH holds the extreme end of the handle and the right hand RH holds the intermediate portion of the stick. The athlete then causes one side of blade portion 20 of the stick to engage the ball 22 to thereby first accelerate the ball from an initial location or position A as shown in FIG. 1 and then apply force to the stick to thereby rapidly move the stick and thereby first accelerate the ball from position A as shown in the direction of a second position B. However, before the ball arrives at position B the athlete quickly lifts up the stick and moves it ahead of the travel of the ball and engages the other side of the blade 20 against the moving ball and then commences to slow the ball down, i.e. decelerates the ball and thus bring the ball to rest at position B. Once the ball has come to rest the athlete then, as part of the same motion, applies reverse force to the stick blade 20 and begins accelerating the ball back towards the initial starting point A. The process is continued repeatedly as long as desired. The exercise occurs in connection with the aforesaid ball acceleration and deceleration being repeated by the athlete. The repetition provides a beneficial strengthening of the wrists and hands of the athlete. A key element of the system is the heavy weight of the ball 22 which is much heavier than a standard hockey puck; this weight facilitates the desired strengthening. FIG. 2 shows some variations for using the system. In FIG. 2 the left foot and right foot are designated by LF and RF respectively. It is seen from FIG. 2 that the athlete can go through a routine directly in front of the athlete by moving the ball back and forth between A and B over a relatively short distance of two to three feet at a relatively fast pace. Or the travel of the ball in front of the athlete may be increased a greater distance such as four to five feet between A′ and B′ as shown in FIG. 2; this routine would usually be associated with a slower repetition rate to permit the athlete to concentrate on stick technique. FIG. 2 also shows that the travel of the ball could be off to right side of the athlete for developing a right hand shot both forehand and backhand, the ball traveling between positions A″ and B″. Additionally FIG. 2 shows how the travel of the ball could be ahead of and off to the left of the athlete again permitting exercise and development of technique for a right hand shot both forehand and backhand, the ball travelling between positions A‴ and B‴.

I have found that having the ball made of forged steel and having a diameter in the range of 2.5 inches to 3.0 inches is optimum. This provides a ball weighing approximately 2.5 pounds to 4.0 pounds and this range of weights for the ball has been found to provide optimum beneficial strengthening of the wrists and hands.

It is to be understood that the embodiment of my invention as shown is for the purpose of illustration and that my invention is limited solely by the scope of the appended claims.

I claim as my invention:

1. A method for developing and strengthening wrists and hands of a human athlete, said method being adapted to be practiced on a flat hard surface by the athlete and with the athlete operating:

(i) a wooden hockey stick having an elongated handle portion and a double-sided blade portion, each side of the blade portion being flat, and (ii) a spherically shaped and dense ball, said ball being of steel material and formed by a forging process and having a diameter in the range of 2.5 to 3.0 inches, whereby the athlete (a) places the ball on the hard surface in front of but proximate to the front of the feet of the athlete and holds the elongated handle portion of the stick with spaced apart hands, and (b) uses the hockey stick to move the ball back and forth on the hard surface by engaging said ball with alternating sides of the blade portion of the hockey stick to thereby accelerate and decelerate the ball, so that, upon the aforesaid ball acceleration and deceleration being repeated by the athlete, a beneficial strengthening of the wrists and hands of the athlete occurs.

* * * * *